US007537058B2

(12) United States Patent
Gullapalli et al.

(10) Patent No.: US 7,537,058 B2
(45) Date of Patent: May 26, 2009

(54) METHOD FOR GAS PRODUCTION FROM GAS HYDRATE RESERVOIRS

(75) Inventors: Irene Gullapalli, San Ramon, CA (US); Emrys Jones, Fallbrook, CA (US); George Moridis, Oakland, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 11/852,833

(22) Filed: Sep. 10, 2007

(65) Prior Publication Data

US 2009/0065210 A1 Mar. 12, 2009

(51) Int. Cl.
*E21B 43/00* (2006.01)

(52) U.S. Cl. ..... 166/369; 166/272.1; 166/370

(58) Field of Classification Search ..... 166/302, 166/369, 272.1, 370
See application file for complete search history.

(56) References Cited

U.S. PATENT DOCUMENTS

| | | | | |
|---|---|---|---|---|
| 4,376,462 | A * | 3/1983 | Elliott et al. | 166/267 |
| 2003/0178195 | A1* | 9/2003 | Agee et al. | 166/248 |
| 2006/0032637 | A1* | 2/2006 | Ayoub et al. | 166/369 |
| 2007/0163780 | A1* | 7/2007 | Onodera et al. | 166/250.07 |

OTHER PUBLICATIONS

Chuang Ji, Goodarz Ahmadi, Duane H. Smith "Natural gas production from hydrate decomposition by depressurization" Chemical Engineerign Science 56 (2001) 5801-5814.*

Goodarz Ahmadi, Chuang Ji, Duane H Smith "Production of natural gas from methane hydrate by a constant downhole pressure well" Energy Conversion and Management 48 (2007) 2053-2068.*

US Department of Energy "Gas Hydrates" US Department of Energy Office of Fossil energy Morgantown Energy Technology Center Jan. 1987 DOE/METC-87/0246.*

George J Moridis, Matthew T Reagan "Strategies for gas production from oceanic Class 3 hydrate accumulations" University of California 2007.*

Moridis et al., Depressurization-induced gas production from Class 1 and Class 2 hydrate deposits, Proceedings, Tough Symposium 2006, Paper LBNL-60366, May 15-17, 2006, pp. 1-8, Lawrence Berkeley National Laboratory, Berkeley, California.

Moridis et al., Strategies for Gas Production from Hydrate Accumulations under Various Geological and Reservoir Conditions, Proceedings, Tough Symposium 2003, May 12-14, 2003, pp. 1-8, Lawrence Berkeley National Laboratory, Berkeley, California.

(Continued)

*Primary Examiner*—David J Bagnell
*Assistant Examiner*—Cathleen R Hutchins
(74) *Attorney, Agent, or Firm*—Christopher D. Northcutt; Maurice E. Teixeira

(57) ABSTRACT

The present invention is directed to using depressurization methods to create mobile fluid zones for producing fluids from a Class 3 hydrate reservoirs through a well. Aspects of the present invention include a two stage method wherein the first stage includes producing fluid from a hydrate interval within the Class 3 hydrate reservoir through a well at a constant pressure and forming an interface, and the second stage includes producing fluid through the interface at a constant mass rate and heating the well.

11 Claims, 6 Drawing Sheets

Schematic Diagram of the Class 3 Hydrate Reservoir Model.

OTHER PUBLICATIONS

NETL National Energy Technology Laboratory, Oil & Natural Gas Technologies, Reference Shelf—Presentation on Strategies for Gas Production From Oceanic Class 3 Hydrate Accumulations, http://www.netl.doe.gov/technologies/oil-gas/ReferenceShelf/Presentations/Presentation-MHFWPG302-2.html.

* cited by examiner

Schematic Diagram of the Class 3 Hydrate Reservoir Model.

METHOD FOR GAS PRODUCTION FROM GAS HYDRATE RESERVOIRS

FIELD OF THE INVENTION

This invention relates generally to fluid production from hydrate reservoirs, and specifically to using depressurization methods to create mobile fluid zones for producing gas from Class 3 gas hydrate reservoirs through a well.

BACKGROUND

Gas hydrates are solid crystalline compounds in which gas molecules are encaged inside the lattices of ice crystals. Under suitable conditions of low temperature, high pressure and favorable geochemical regimes, gas, usually methane ($CH_4$), will react with water to form gas hydrates. Gas hydrate is abundant along deepwater continental margins and arctic regions, trapped in hydrate accumulations or reservoirs. Current estimates of the worldwide total quantity of recoverable gas in hydrate reservoirs range between $3.1\times10^3$ to $7.6\times10^6$ trillion cubic meters in oceanic sediments. Estimates range from 2 to 10 times the amount of gas in all known remaining recoverable gas occurrences worldwide is bound in gas hydrates. While the magnitude of this resource makes gas hydrate reservoirs a future energy resource, producing from gas hydrate reservoirs provides unique technical challenges.

Natural gas hydrate reservoirs are divided into three main classes according to their geologic and reservoir conditions which can, in turn, dictate production strategies. Class 1 hydrate reservoirs comprise two zones: a hydrate-bearing interval, and an underlying two phase mobile fluid zone with free gas. Class 2 hydrate reservoirs comprise two zones: a hydrate-bearing interval overlying a mobile fluid zone with no free gas, e.g., an aquifer. Class 3 hydrate reservoirs have a single hydrate-bearing interval, and are characterized by having substantially no underlying mobile fluid zone (here after referred to as "Class 3" hydrate reservoirs). Gas can be produced from gas hydrate reservoirs by inducing dissociation using one or more of the following three main methods: (1) depressurization, (2) thermal stimulation, and (3) chemical stimulation. Depressurization methods can utilize existing production technologies and facilities but require a permeable or mobile fluid zone to produce the gas released from the dissociating hydrate. Thermal stimulation typically involves injection of hot water or steam into, the formation which requires a heat source, additional equipment and costs. Chemical stimulation can involve the injection of hydration inhibitors such as salts and alcohols which can lead to rapid dissociation and fracturing, potentially causing a breach of the reservoir. In addition, injection of hydration inhibitors requires expensive chemicals whose effectiveness is progressively reduced as released water dilutes its effect.

In terms of gas production, Class 3 hydrate reservoirs pose the largest technical challenge due to the lack of mobile fluid zones in direct contact with the hydrate interval. Gas can be readily produced from Class 1 and most Class 2 hydrate reservoirs by means of depressurization methods using conventional technology with or without a combination of thermal stimulation or chemical stimulation methods. Because of adverse permeability conditions, thermal and chemical stimulation methods have been the only production options for class 3 hydrate reservoirs, both of which are inefficient and expensive in comparison to depressurization methods.

In view of the foregoing, the contribution of the present invention resides in the discovery of a new depressurization-induced dissociation method for producing gas from Class 3 hydrate reservoirs through a well using conventional oilfield technologies, without the use of thermal or chemical stimulation.

BRIEF DESCRIPTION OF THE INVENTION

Aspects of embodiments of me present invention provide a two stage depressurization method for producing fluid from Class 3 hydrate reservoirs. The first stage includes producing fluid from a hydrate interval within the Class 3 hydrate reservoir through a well at a constant pressure. The second stage includes producing fluid from the hydrate interval through the well at a constant mass rate once secondary hydrates form and heating the well at the hydrate interval while producing fluid from the hydrate interval at a constant rate. Another aspect of an embodiment of the present invention includes a two stage depressurization method for producing fluid from Class 3 hydrate reservoirs wherein the first stage includes producing fluid from an upper section of a hydrate interval within the Class 3 hydrate reservoir through a well at a constant pressure and forming an interface capable of producing at a desired production rate during the step of producing fluids from the hydrate interval at a constant pressure. The second stage includes producing fluid through the interface from a lower section of a the hydrate interval through the well at a constant mass rate once secondary hydrates form and heating the well at the hydrate interval while producing fluid from the lower section of the hydrate interval at a constant mass rate and reducing the constant mass rate production once cavitations form.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form apart of this specification, wherein like reference numerals designate corresponding parts in the various FIGS. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
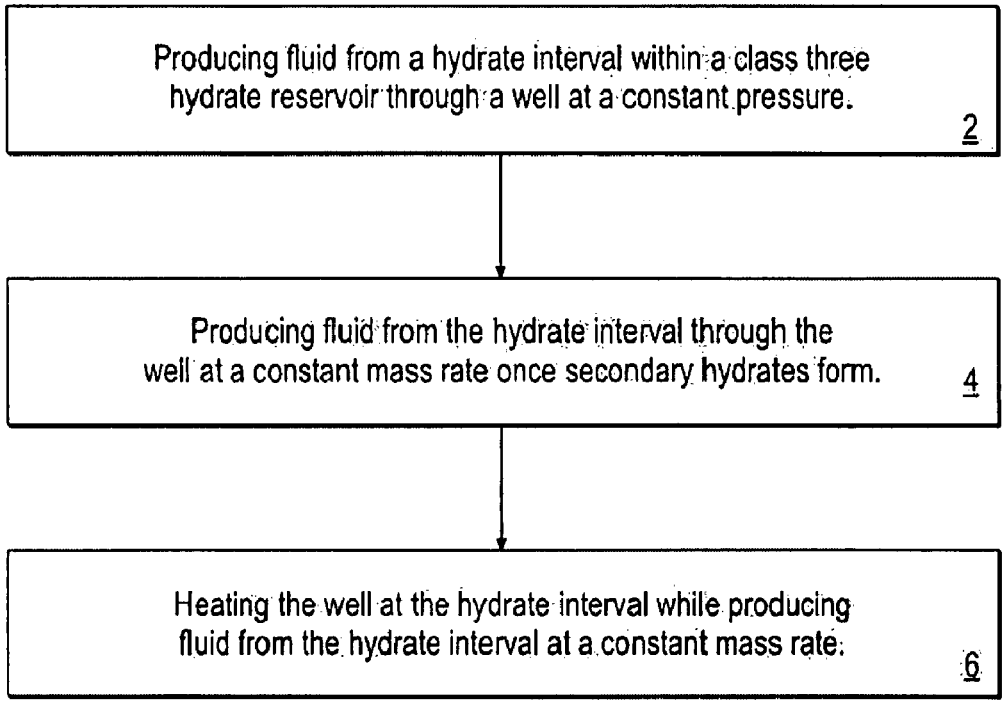
FIG. 1 is a flowchart of one embodiment, of the present invention illustrating a two stage depressurization method for producing fluid from, a Class 3 gas hydrate reservoir.

FIG. 1 illustrates one embodiment of the present invention showing a two stage depressurization method for producing fluid from a Class 3 gas hydrate reservoir. During the first stage, indicated at reference 2, hydrate dissociation is induced by depressurization using a constant-pressure production regime at the well, and fluids are produced through a well that is partially or fully completed in the hydrate interval of the Class 3 gas hydrate deposit. Constant-pressure production refers to a production regime where the well is kept at a constant pressure, the production rate may change with time as the pressure difference between the well and the formation changes. Another possibility is constant-rate production, when the rate is specified and stays constant overtime while the well downhole-pressure varies. The second stage, indicated at reference 4, begins when dissociation during the first stage has created a sufficiently large hydrate-free zone underneath the receding base of the hydrate interval and secondary hydrates begin to form. The term secondary hydrate refers to the formation of hydrates that are riot originally in place ("primary, hydrates") when production begins, but are formed at a later time when the pressure and temperature are such that they can be stable. For example, primary hydrates may dissociate in the vicinity of the well during production, but may reform at a later time as secondary hydrates as a result of the availability of gas and water, and substantial cooling, caused by the advancing dissociation and the Joule-Thompson effect that is strongest next to the well where the gas velocity is at its highest. The dissociation-induced hydrate-free zone is a mobile fluid zone ("interface") that can serve as a conduit for the production of fluids from the hydrate interval to the well. The production regime is then switched using conventional methods from constant pressure to constant mass rate production. Mass production rate refers to the total mass rate of the produced fluids at the well; the pressures may vary but the mass production rate remains constant. For example, a mass production rate of 10 lbs/sec indicates that the sum of the mass of water arid gas produced is 10 lbs/sec. Ideally, the constant mass rate is the maximum sustainable production rate that the hydrate interval can support and can be initially set at double the rate at the time of the switch. The Heat is supplied to the well at the hydrate interval during production, as indicated at reference 6.

Figure 2:
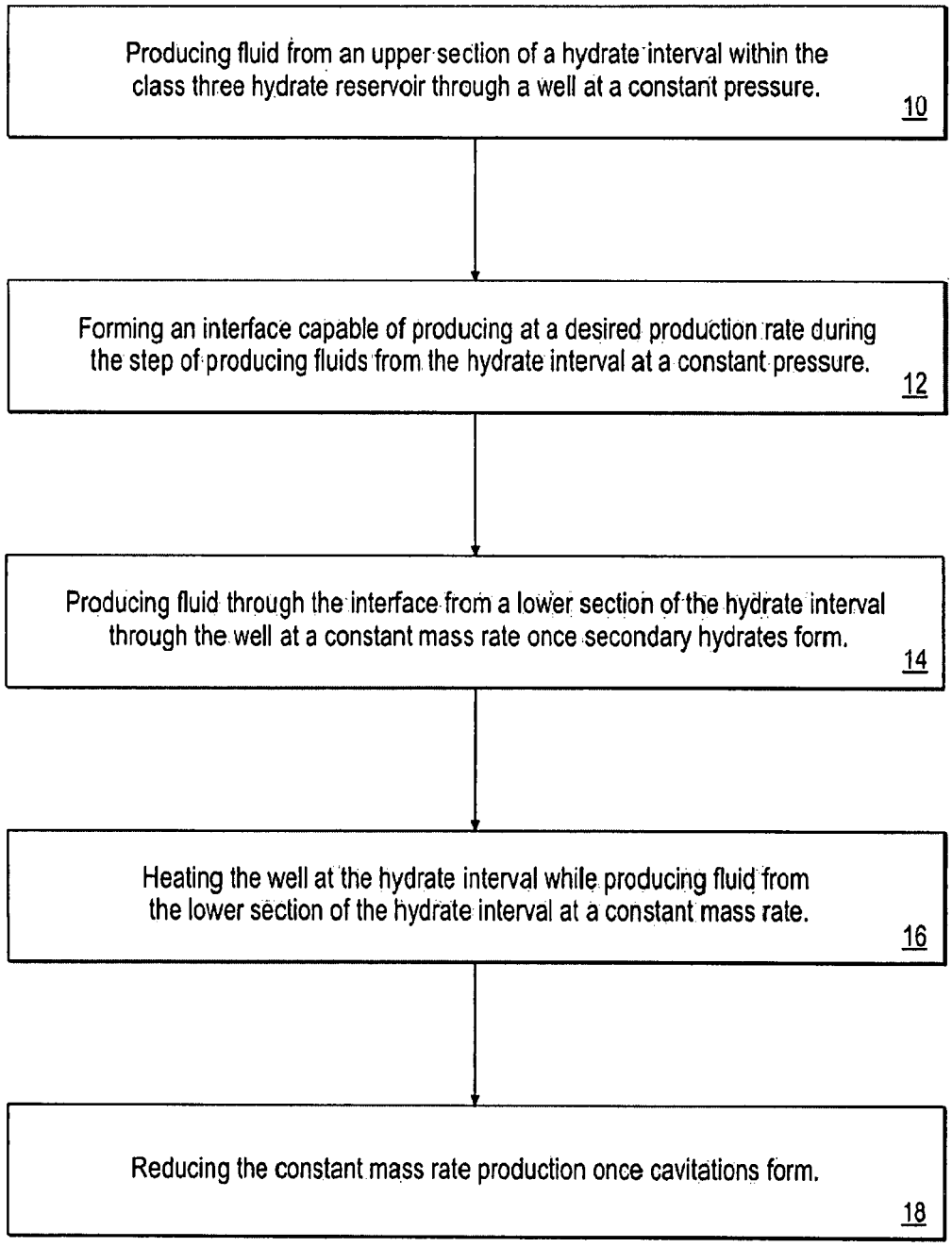
FIG. 2 is a flowchart of another embodiment of the present invention illustrating a two stage depressurization method for producing fluid from a Class 3 gas hydrate reservoir.

In another embodiment of the present invention, as shown in FIG. 2, the first stage of producing fluids may be from an upper section of the hydrate interval within the Class 3 gas hydrate reservoir, through a well at a constant pressure 10. Production at constant pressure from the upper section of the hydrate interval is carried out without well heating to form the largest possible interface. Production at constant pressure continues until the interface is large enough to be capable of producing fluid at a desired mass rate 12. Thereby transforming the Class 3 gas hydrate reservoir to a pseudo-Class 2 gas hydrate reservoir using depressurization to induce dissociation and the creation of an interface in the lower section of the hydrate interval while producing fluids. When secondary hydrates begin to form near the well the second stage of producing fluids at a constant mass rate through the newly formed interface 14 can begin from a lower section of the hydrate interval which acts as a conduit in transporting the fluid to the well. The well is heated using conventional methods at the hydrate interval while producing fluid from the lower section of the hydrate interval at a constant mass rate 16. The constant mass rate production is reduced once cavitations begin to form 18. Cavitations will typically form as a result of rapid pressure drop due the inability of the system to produce at the imposed mass production rate at the well.

Figure 3:
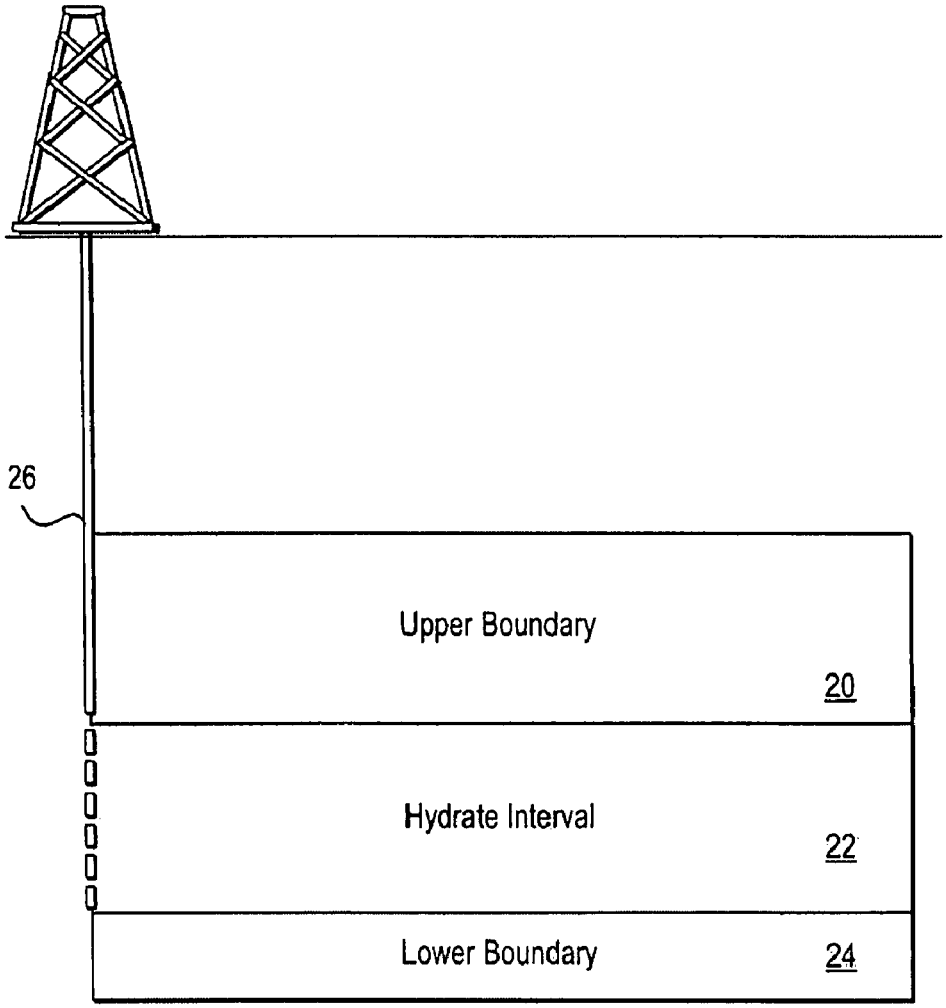
FIG. 3 is a schematic diagram of the Class 3 gas hydrate reservoir model.
Figures 4A, 4B, 4C, 4D:
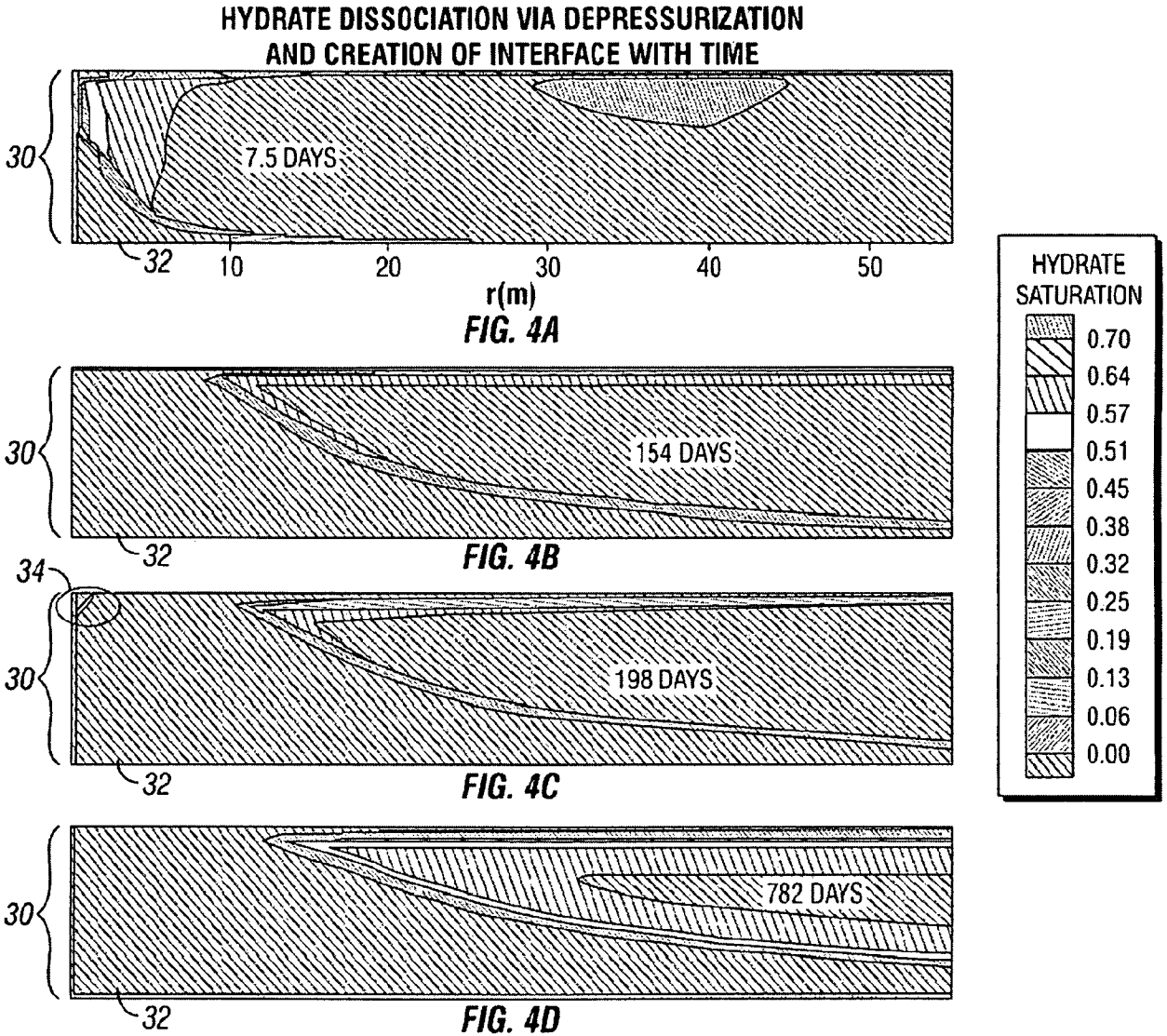
FIG. 4A through FIG. 4D are schematic drawings of hydrate dissociation using depressurization and creation of an interface with time.

FIG. 3 is a schematic diagram of a Class 3 gas hydrate reservoir model. Class 3 gas hydrate reservoirs in particular are characterized by an isolated hydrate-bearing layer or hydrate interval 22 that is riot in contact with any mobile fluid zones, and are encountered in the permafrost and in deep ocean sediments. The upper boundary 20 of the hydrate reservoir is typically impermeable shale, but may be any material capable of forming a reservoir cap of seal. The lower boundary 24 is typically permeable or impermeable shale, but may be other geologic formations. Using the two stage depressurization methods of the present invention, fluids such as gas and water may be produced from Class 3 hydrate reservoirs through a well 26 using conventional oilfield technologies and facilities technologies.

Gas production from Class 3 reservoirs is affected by the initial pressure, temperature, and hydrate saturation and by the intrinsic permeability of the hydrate interval. Gas hydrate depressurization induced dissociation and the creation of an interface with time is shown in FIG. 4A-FIG. 4D. Four schematics are shown (FIG. 4A-FIG. 4D) illustrating the creation and radial growth from the well in meters of the hydrate free interface 32 at 7.5 days (FIG. 4A), 154 days (FIG. 4B), 198 days (FIG. 4C), and 782 days (FIG. 4D) from the initiation of production at a constant pressure. In this illustrative example the initial conditions at the bottom of the hydrate interval 30 are 68.81° F., 4,527 psia, and the hydrate saturation is 50% and greater. In this numerical model of long-term gas production from a representative of Class 3 gas hydrate reservoirs, producing fluids using a constant pressure is an efficient method to create an interface in the hydrate interval. In time the dissociation interface is capable of providing a conduit for the production of dissociated gas and water. At the end of Stage 1, secondary hydrate may have formed in the vicinity of the wellbore 34. In the ensuing Stage 2, constant-pressure production ceases, and is replaced by constant-mass rate production. The well is heated during Stage 2 at the hydrate interval to prevent the continuation of secondary hydrate formation.

Figure 5:
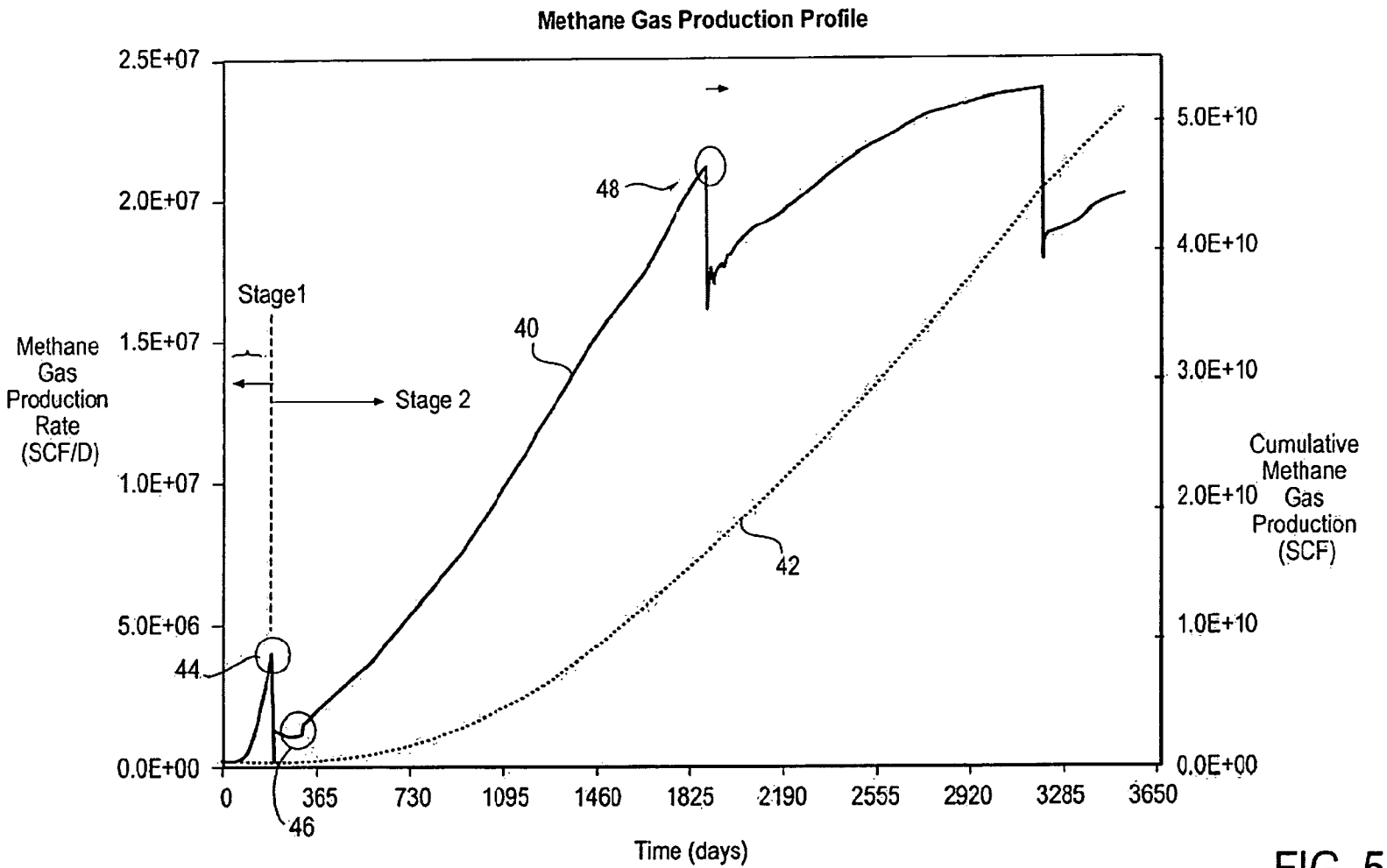
FIG. 5 is a graph indicating the methane gas production profile of one embodiment of the present invention.

FIG. 5 is a graph indicating the methane gas production profile of one embodiment of the present invention. The initial conditions of the Class 3 gas hydrate reservoir illustrated in FIG. 5 include, but are not limited to: hydrate saturation in the hydrate interval ($S_H$)=0.7, and permeability (K)=1000 mD. The profile shows the production rate $CH_4$ released during dissociation in standard cubic feet per day (SCF/D) at solid line 40, and the cumulative production of $CH_4$ at broken line 42, over time. During Stage 1, the pressure is adjusted at a well in fluid communication with the hydrate interval, or at the associated topside facility, to maintain a constant pressure of at least 1,000 psia less than the initial reservoir pressure. Large, amounts of water are produced during Stage 1. Further reducing the pressure will result in increased dissociation rates and therefore, increased water production. When the substantially hydrate-tree interface underneath the base of the hydrate interval is sufficiently large, Stage 2 is initiated, as indicated at reference 44, and the production scenario is switched to a constant mass rate. Once the interface is formed to provide a conduit for the production of gas, water production declines quickly as gas production increases, as indicated at reference. Heat is applied at the well or wells over the hydrate interval during Stage 2 to discourage the formation of secondary hydrates at the well. In this illustrate example of one embodiment of the present invention, gas production can achieve rates of 20 MM SCF/D within 5 years, at which time it may become necessary to reduce the constant mass rate production to overcome of prevent cavitations, as indicated at reference 48.

Figure 6:
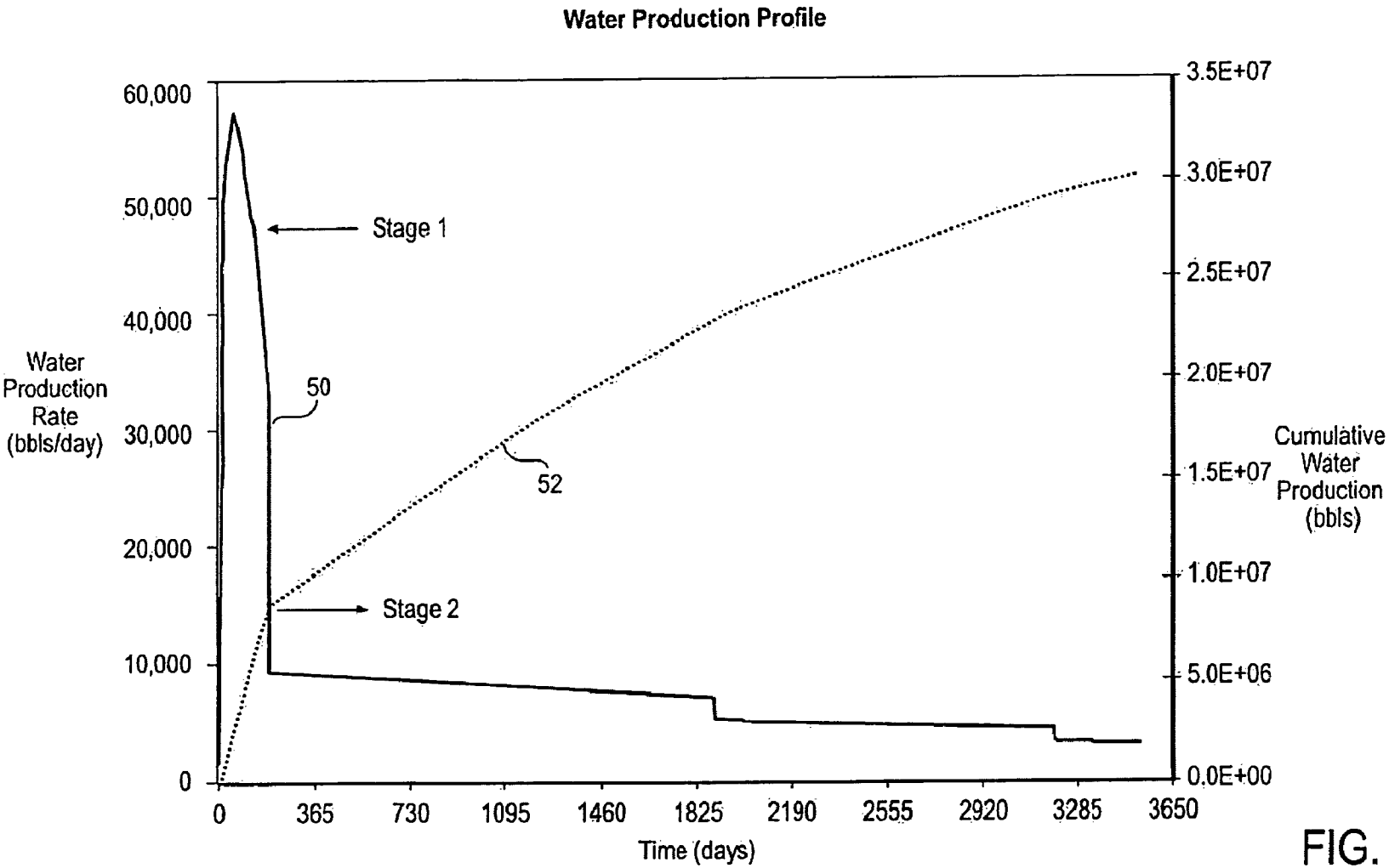
FIG. 6 is a graph indicating the water production profile of one embodiment of the present invention.

Gas production from hydrates is accompanied by a significant production of water, as illustrated in FIG. 6, showing the water production profile of one embodiment of the present invention. The profile shows the production rate of water released during dissociation in barrels/day (bbls/day) at solid line 50, and the cumulative production of water at broken line 52, over time. Large amounts of water are produced during Stage 1, until the interface is formed to provide a conduit for the production of gas. The water production declines quickly as gas production increases during Stage 2, and the production scenario is switched to constant mass rate production. The water production rate declines with time.

The examples herein are provided to demonstrate particular embodiments of the present invention. It should be appreciated by those of skill in the art that methods disclosed in the examples merely represent exemplary embodiments of the present invention. However, those of skill in the art should, in light of the present disclosure, appreciate that many changes can be made in the specific embodiments described and still obtain a like or similar result without departing from the spirit and scope of the present invention.

All patents and publications referenced herein are hereby incorporated by reference to the extent not inconsistent herewith. It will be under stood, that certain of the above-described structures, functions, and operations of the above-described embodiments are not necessary to practice the present invention and are included in the description simply for completeness of an exemplary embodiment or embodiments. In addition, it will be understood that specific structures, functions, and operations set forth in the above-described referenced patents and publications can be practiced in conjunction with the present invention, but they are not essential to its practice. It is therefore to be understood that the invention may be practiced otherwise than as specifically described without actually departing from the spirit and scope of the present invention as defined by the appended claims.

What is claimed is:

1. A two stage depressurization method for producing fluid from Class 3 hydrate reservoirs, comprising the steps of:

(a) producing fluid from a hydrate interval within the Class 3 hydrate reservoir through a well at a constant pressure until a sufficient amount of secondary hydrates have formed within the hydrate interval; and (b) producing fluid from the hydrate interval through the well at a constant mass rate subsequent to the forming of the sufficient amount of secondary hydrates within the hydrate interval.

2. The method of claim 1 wherein the producing fluid from the hydrate interval at a constant pressure in step (a) includes producing fluid from an upper section of the hydrate interval.

3. The method of claim 1 wherein the producing fluid from the hydrate interval at a constant mass rate in step (b) includes producing fluid from a lower section of the hydrate interval.

4. The method of claim 1 wherein the producing fluid from the hydrate interval at a constant mass rate in step (b) is through an interface which is formed during the producing fluid from the hydrate interval at a constant pressure in step (a).

5. The method of claim 4 wherein the producing fluid from the hydrate interval at a constant mass rate in step (b) is initiated when the interface is capable of producing at a desired mass rate.

6. A two stage depressurization method for producing fluid from Class 3 hydrate reservoirs, comprising the steps of:

(a) producing fluid from an upper section of a hydrate interval within the Class 3 hydrate reservoir through a well at a constant pressure until an interface is formed that is capable of transporting fluid to the well at a desired constant mass rate; and (b) producing fluid through the interface from a lower section of the hydrate interval through the well at the desired constant mass rate subsequent to the forming of the interface that is capable of transporting fluid to the well at the desired constant mass rate.

7. The method of claim 1 wherein the well is heated at the hydrate interval while performing step (b).

8. The method of claim 1 further comprising reducing the constant mass rate to a second lower constant mass rate if cavitations begin to form.

9. The method of claim 6 wherein the well is heated at the hydrate interval while performing step (b).

10. The method of claim 6 further comprising reducing the desired constant mass rate to a second lower constant mass rate if cavitations begin to form.

11. The method of claim 6 wherein the producing fluid through the interface from a lower section of the hydrate interval through the well at the desired constant mass rate in step (b) is subsequent to forming of secondary hydrates within the hydrate interval.

* * * * *